United States Patent [19]

Yonker et al.

[11] Patent Number: 4,530,485

[45] Date of Patent: Jul. 23, 1985

[54] VALVE

[76] Inventors: John H. Yonker, 2212 San Simeon Pl., Carrollton, Tex. 75006; Charles R. Williams, 3108 Afton, Carrollton, Tex. 75007; Otto J. Granhaug, Esso Exploration and Production Norway, Inc., P.O. Box 560, 4001 Stavanger, Norway

[21] Appl. No.: 639,266

[22] Filed: Aug. 9, 1984

[51] Int. Cl.[3] ..... E21B 34/10

[52] U.S. Cl. ..... 251/93; 251/297; 251/92; 166/319; 166/323

[58] Field of Search ..... 251/93, 92, 94, 89.5, 251/89, 113, 62, 297; 166/321, 322, 323, 324, 319, 375; 137/60 R, 71, 495, 629, 624.13

[56] References Cited

U.S. PATENT DOCUMENTS

| | | | |
|---|---|---|---|
| 3,070,119 | 12/1962 | Raulins | 251/297 |
| 3,696,868 | 10/1972 | Taylor, Jr. | 166/323 |
| 3,882,935 | 5/1975 | Calhoun | 166/323 |
| 3,886,967 | 6/1975 | Nelson | 251/89 |
| 3,896,876 | 7/1975 | Crowe | 166/323 |
| 3,939,913 | 2/1976 | Mott | 166/375 |
| 4,022,273 | 5/1977 | Marathe | 166/322 |
| 4,276,937 | 7/1981 | Calhoun et al. | 251/62 X |
| 4,339,001 | 7/1982 | Paschal, Jr. | 166/323 |
| 4,449,587 | 5/1984 | Rodenberger et al. | 166/323 |
| 4,469,179 | 9/1984 | Crow et al. | 166/319 |

*Primary Examiner*—James C. Yeung
*Assistant Examiner*—Helen Ann Odar

[57] ABSTRACT

A valve having a tubular body with a valve seat and valve member controlled by a valve operator with provisions for latching the valve operator with the valve member in partially open position utilizing a snap ring which is propped out into a groove in the body and provides a stop maintaining the valve partially open against a spring and in which the valve operator has a receiving groove which receives the snap ring and maintains it in an out-of-the-way position upon movement of the valve operator toward full valve-open position.

3 Claims, 2 Drawing Figures

VALVE

Figure 1:
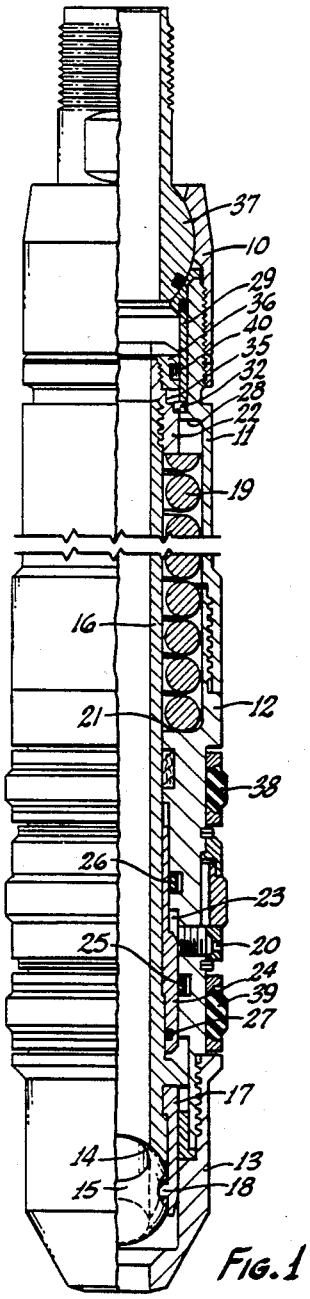

This invention relates to valves and, more particularly, to a subsurface safety valve which is run with the valve propped partially open.

In the past it has generally been conventional in running subsurface safety valves to prop open the safety valve utilizing a prong which forms a part of the running tool. The application of Crow, Ser. No. 06/331,641 filed Dec. 17, 1981, shows a subsurface safety valve which is run latched in the open position utilizing a telescoping operator which is releasably latched in extended position and then latched in collapsed position in response to pressuring up the valve operator piston. Another type of latch which is said to be capable of being utilized to latch a valve member in open position is shown at page 913 of the 35th Revision of the *Composite Catalog of Oil Field Equipment and Services.* This latch apparently is not utilized during running of the valve.

These prior art devices are complicated and relatively expensive to fabricate.

It is an object of this invention to provide a safety valve with a latch system to be utilized during running of the valve which is simple, inexpensive, and substantially failure proof.

Another object is to provide a latch system for a subsurface safety valve in which the valve member is releasably latched in partially open position by a snap ring and, upon pressuring up the valve to move the valve member to full open position, the snap ring is moved into an out-of-the-way position which does not thereafter interfere with the full operation of the valve.

Another object is to provide a subsurface safety valve in which a snap ring maintains the valve operator in partial valve-open position in which the snap ring is transferred from a groove in the housing to a groove in the valve operator upon pressuring up of the valve to move the valve member toward full open position to release the valve and place it in full operational condition.

Other features, objects and advantages of the invention will be apparent from the drawing, the specification and the claims.

Figure 2:
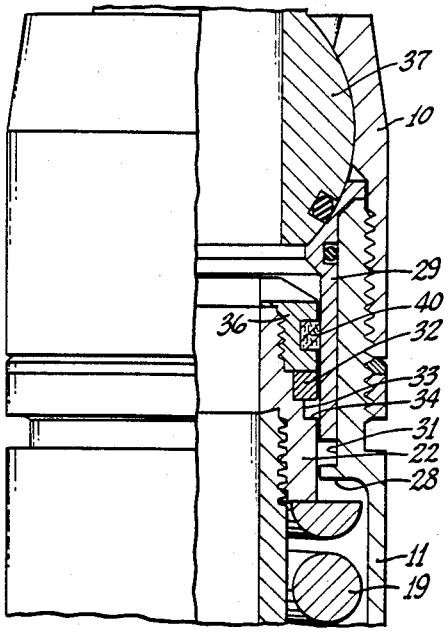

In the drawing wherein like reference numerals indicate like parts:

FIG. 1 is a view partially in vertical elevation and partially in vertical cross-section illustrating a valve constructed in accordance with this invention dressed for running with the valve member partially open; and FIG. 2 is a fragmentary view of the latch section of the valve and showing the snap ring to have been released from its FIG. 1 position and to be carried by the valve operator in an out-of-the-way position.

The latch of this invention has been applied to a valve which is fully disclosed in U.S. Pat. No. 4,428,557 dated Jan. 31, 1984 to Yonker, et al. The disclosure of this patent is incorporated herein in its entirety by reference.

Referring now to the drawings, the subsurface safety valve illustrated is designed for pumpdown completions, but it will be appreciated that other types of subsurface safety valves, such as wireline run valves or valves run as a part of the tubing, may be dressed in accordance with this invention to be run open and left open until it is desired to place the valve in operation.

The valve includes a tubular body made up of the upper socket 10, the spring housing 11, the seal housing 12, and the lower sub 13.

Within the body a valve seat 14 is cooperable with a valve member provided by the ball valve 15 to control flow through the tubular body.

A valve operator 16 carries the seat 14 at its lower end and is reciprocal to move the valve member 15 between its open and closed positions. This is accomplished by the valve operator 14 carrying the depending arms 17 having pins 18 thereon cooperable with matching holes in the valve member to force the valve member to translate vertically with reciprocation of the valve operator. Other pins (not shown) extend between the body and valve member and effect rotation of the ball valve 15 with reciprocation of the actuator 16 in the conventional manner.

The valve is opened or closed by operator 16. The operator 16 is reciprocated by the resilient means provided by the spring 19 in a direction to move the ball valve 15 to valve closed position. The spring 19 is held between the shoulder 21 in the seal housing 12 and a prop-out stop nut 22 provided at the upper end of the valve actuator 16. The operator 16 is reciprocal in a downward direction to move the ball valve 15 to open position by pressure introduced through port 20 into the pressure chamber 23 where it is effective on the floating piston 24. This piston is sealed with the housing by the seals 25 and 26 and with the operator by the seal 27. Thus, pressurizing of the chamber 23 drives the piston 24 and the valve operator 16 downwardly to move the ball valve 15 to open position. As will be understood by those skilled in the art, the floating piston permits pumping down and forcing the ball valve off of its seat by internal pressure without having to force the piston 24 down against well pressure.

The valve member is latched in partially open position and released by a snap ring which is transferred from a groove in the body to a groove in the operator upon initial pressuring up of chamber 23.

A snap ring lock groove is provided in the body. In the illustrative embodiment the upper end of the spring housing 11 is provided with an inwardly projecting flange 28. A knuckle joint sleeve 29 is held between the spring housing 11 and the upper socket 10 with the lower end of the sleeve 29 spaced from the flange 28 to provide the snap ring lock groove 31.

A snap ring 32 is provided in this locking groove 31 when the tool is dressed at the surface prior to running.

The valve operator is provided with a prop-out stop which expands and props out the snap ring 32 in groove 31. The valve operator is further provided with a stop means which abuts the ring and releasably maintains the valve member in the partially open position shown in FIG. 1 against the force exerted by the spring 19.

Preferably, the prop-out stop is provided by a prop-out surface on the operator and a stop shoulder on the operator. In the illustrated embodiment, the prop-out stop is provided on the nut 22 by the cylindrical surface 33 on the outer diameter of the nut which maintains the snap ring in an expanded position when the operator is in the FIG. 1 position. The prop-out stop also includes the stop shoulder 34 facing toward the top of the valve which engages the snap ring 32 when the valve is initially dressed so that the operator is releasably latched with the ball valve 15 in the partially open position, as shown in FIG. 1.

The operator has a receiving groove which is located on the side of the prop-out stop remote from the valve member for receiving the snap ring in a position to clear the lock groove upon movement of the valve operator toward valve open position in response to control pressure fluid to render the valve operational. This receiving groove 35, preferably, is also provided in the prop-out stop nut 22 and receives the snap ring 32 and permits the ring to contract into the receiving groove where it does not interfere with normal reciprocation of the valve operator in moving between open and closed positions. Preferably the snap ring is sized to be slightly smaller than the receiving groove when in unstressed condition. The O.D. of the ring is further less than the I.D. of sleeve 29 when in the receiving groove and does not interfere with normal operation of the valve.

As indicated above, it is preferred that the prop-out stop and the receiving groove be provided in the prop-out stop nut 22 and this may be provided by the two-step groove provided by shoulder 34, the larger diameter step 33 which functions as the prop-out and the smaller diameter step 35 which functions as a part of the snap ring receiving groove. The receiving groove is completed by the nut 36 carried at the upper end of the prop-out stop nut. This nut 36 carries a wiper 40 which wipes the inner diameter of the seat sleeve 29 with reciprocation of the operator.

When the tool is designed for pumpdown operations, the upper socket 10 will surround a ball 37 to permit the tool to traverse the conventional five foot radius loop at the well entrance.

As is conventional, the valve is provided with upper and lower external seals 38 and 39 which engage seal bores in the landing nipple when the subsurface safety valve is landed in the nipple and seals between the valve and nipple on opposite sides of the pressure fluid inlet 20.

In operation the tool will be assembled with the snap ring 32 in the position shown in FIG. 1 which will hold the valve operator 16 in a lower position in which the ball valve 15 is partially open, as illustrated. Thus, the open valve will not impede pumping in of the valve and landing it in its appropriate nipple. In like manner, the valve could have its upper sub designed for wireline use and the tool run in conventional manner, utilizing wireline techniques.

As a further alternative, the valve might be designed to be a part of a tubing string and dressed in the manner illustrated with the snap ring 32 to maintain the valve in partially open position.

When it is desired to place the valve in service, the subsurface safety valve is pressured up by delivering pressure fluid from the surface through the port 20 into the chamber 23 to drive the piston 24 and the valve operator 16 downwardly. As the valve operator moves downwardly, the receiving groove 35 moves under the snap ring 32. As the ring was expanded from its non-stress position by the prop-out surface 33 into the lock groove, the removal of the prop-out surface 33 will permit the snap ring to snap to a smaller diameter and move into the receiving groove 35 where its outer diameter is less than the inner diameter of the seat sleeve 29 and it will no longer have any effect on the operation of the valve. Thereafter, the valve may be cycled between open and closed positions by the action of spring 19 and control pressure fluid within the chamber 23.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A subsurface safety valve comprising, a tubular body, a valve seat and valve member in the body controlling flow there through, a valve operator for the valve member reciprocal by resilient means toward valve closed position and toward valve-open position by control pressure fluid, a snap ring lock groove in the body, a snap ring, a prop-out stop on said valve operator expanding said snap ring into said lock groove and abutting said ring to releasably maintain the valve member in partially open position against the force exerted by said resilient means, and a receiving groove in the valve operator on the side of the prop-out stop remote from said valve member for receiving the snap ring in a position to clear said lock groove upon movement of said valve operator toward complete valve-open position in response to control pressure fluid to render the valve operational.

2. The valve of claim 1 wherein the prop-out stop is provided by a two-step groove in the outer diameter of the valve operator with the larger diameter section of the two-step groove providing a prop-out surface and stop for expanding the snap ring into said lock groove and the smaller diameter groove provides said receiving groove.

3. The valve of claim 2 wherein the prop-out stop is provided by a nut carried on the valve operator and having said two-step groove in its outer diameter.

* * * * *